US011761647B2

(12) United States Patent
Baverstock et al.

(10) Patent No.: US 11,761,647 B2
(45) Date of Patent: Sep. 19, 2023

(54) AIR CONDITIONING MODULE

(71) Applicant: WISE EARTH PTY LTD, Swanbourne (AU)

(72) Inventors: Garry Frederick Baverstock, Cottesloe (AU); Sam Peter Paolino, Waterford (AU); Stephen Frederick Lucks, Willetton (AU)

(73) Assignee: Wise Earth Pty Ltd., Western Australia (AU)

( * ) Notice: Subject to any disclaimer, the term of this patent is extended or adjusted under 35 U.S.C. 154(b) by 0 days.

(21) Appl. No.: 16/755,755

(22) PCT Filed: Oct. 11, 2018

(86) PCT No.: PCT/AU2018/051099
§ 371 (c)(1),
(2) Date: Apr. 13, 2020

(87) PCT Pub. No.: WO2019/071310
PCT Pub. Date: Apr. 18, 2019

(65) Prior Publication Data

US 2020/0271337 A1 Aug. 27, 2020

(30) Foreign Application Priority Data

Oct. 13, 2017 (AU) ..... 2017904157

(51) Int. Cl.
*F24F 5/00* (2006.01)
*F28D 7/00* (2006.01)
(Continued)

(52) U.S. Cl.
CPC ..... *F24F 5/0042* (2013.01); *F24F 5/0046* (2013.01); *F28D 7/0008* (2013.01);
(Continued)

(58) Field of Classification Search
CPC ..... F24F 5/0042; F24F 5/0046; F24F 2005/0082; F24F 2005/0067; F28D 7/008; F28D 21/0001
See application file for complete search history.

(56) References Cited

U.S. PATENT DOCUMENTS 2,903,857 A 9/1959 Lindenblad
3,040,538 A * 6/1962 Alsing ..... F24F 1/0378 62/3.2
(Continued)

FOREIGN PATENT DOCUMENTS

CN 101675718 A 3/2010
CN 102288061 12/2011
(Continued)

OTHER PUBLICATIONS

International Search Report for PCT/AU2018/051099, dated Dec. 17, 2018, 5 pages.
(Continued)

*Primary Examiner* — Devon Russell
(74) *Attorney, Agent, or Firm* — Patterson Thuente, P.A.

(57) ABSTRACT

An air conditioning module including a thermo electric cell having a first side and a second side; an conditioning duct attached to the first side of the thermo electric cell; and an exhaust duct attached to the second side of the thermoelectric cell; wherein the conditioning duct receives and conditions air from a room, and the exhaust duct vents unwanted thermal energy.

20 Claims, 8 Drawing Sheets

(51) Int. Cl.
*F28D 21/00* (2006.01)
*F28F 1/40* (2006.01)
*F28F 21/08* (2006.01)

(52) U.S. Cl.
CPC ..... *F28D 21/0001* (2013.01); *F28F 1/40* (2013.01); *F28F 21/084* (2013.01); *F24F 2005/0067* (2013.01); *F28F 2250/08* (2013.01); *F28F 2255/16* (2013.01); *F28F 2270/00* (2013.01)

(56) References Cited

U.S. PATENT DOCUMENTS 3,197,342 A * 7/1965 Neild, Jr. ..... H01L 35/32 136/210
3,552,133 A * 1/1971 Lukomsky ..... F24F 5/0042 62/3.3
4,020,989 A * 5/1977 Kautz ..... E04B 1/7612 126/616
4,065,936 A * 1/1978 Fenton ..... F25B 21/02 62/3.3
4,316,363 A * 2/1982 McKirdy ..... F24F 12/003 62/89
4,463,569 A * 8/1984 McLarty ..... F25B 21/04 62/3.2
6,510,696 B2 * 1/2003 Guttman ..... A41D 13/005 62/259.3
6,548,750 B1 * 4/2003 Picone ..... H01L 35/30 136/203
7,788,933 B2 * 9/2010 Goenka ..... F28D 1/05316 62/3.7
8,091,615 B2 * 1/2012 Houfuku ..... F28F 1/40 165/133
8,359,871 B2 * 1/2013 Woods ..... F25B 21/02 62/3.2
8,640,466 B2 * 2/2014 Bell ..... F25B 21/02 62/3.7
8,704,076 B2 * 4/2014 Braun ..... F24F 5/0042 136/204
9,291,375 B2 * 3/2016 Brehm ..... F25B 21/02
9,360,240 B2 * 6/2016 Hojer ..... F25B 21/04
9,954,157 B2 * 4/2018 Gaiser ..... H01L 35/32
2005/0279105 A1 * 12/2005 Pastorino ..... F25B 21/02 62/3.7
2016/0138877 A1 * 5/2016 Lang ..... F28F 1/40 165/182
2017/0254550 A1 * 9/2017 Poccianti ..... E04B 1/74
2019/0145655 A1 * 5/2019 Conrad ..... B01D 46/0005 165/119

FOREIGN PATENT DOCUMENTS

CN 102288061 A 12/2011
CN 203605387 U 5/2014
CN 2036005387 U 5/2014
CN 105180327 12/2015
JP 2011-247512 A 12/2011

OTHER PUBLICATIONS

Written Opinion of the ISA for PCT/AU2018/051099, dated Dec. 17, 2018, 5 pages.
Written Opinion of the IPEA for PCT/AU2018/051099, dated Aug. 9, 2019, 4 pages.
International Preliminary Report on Patentability for PCT/AU2018/051099, dated Feb. 13, 2020, 16 pages.
Search Report dated Nov. 30, 2020 for EP Application No. 18866335.5, 7 pages.
Indian Examination Report, Indian Application No. 202017019001, dated Mar. 9, 2022, 7 pages.

* cited by examiner

AIR CONDITIONING MODULE

RELATED APPLICATIONS

The present application is a National Phase entry of PCT Application No. PCT/AU2018/051099, filed Oct. 11, 2018, which claims priority from AU Patent Application No. 20179044157, filed Oct. 13, 2017, said applications being hereby incorporated by reference herein in their entireties.

FIELD OF THE INVENTION

The present invention relates to an air conditioning module that utilizes a thermal electric cell, and could be coupled to photovoltaic panels.

BACKGROUND TO THE INVENTION

To improve the comfort of occupants many buildings incorporate air conditioning systems. That is, either the removal or addition of heat to a room as required. To cool a room the air conditioner can draw heat out of the room and transfer that heat to the outside. To warm a room the process could effectively be reversed and the air conditioner acts as a heat pump.

Various techniques are, or have been, used to control room conditions. Possibly the most common type is a refrigerated air conditioner. Hot air from the building flows over coils in a condenser located outside the building. The coils have a cold refrigerant inside them, which absorbs the heat from the air allowing cooled air to be returned to the building.

Another common technique is evaporative cooling. In these systems warm air is drawn from outside and passed through pads filled with water. As evaporation of the water occurs the air is cooled and then pumped into the building.

In some military and consumer product applications, a Peltier or thermal electric cell air conditioner has been used. This system works by applying a DC power source to two elements of a semiconductor. When the power is applied, one side of the device will get cool. This side is located inside the area to be cooled and a fan is used to circulate air to cool the area. These systems are very robust in a vibrational environment and thus attractive for use in applications such as armoured vehicles and tanks. The higher the outputs in power needed for heating or cooling the higher demands required from primary energy supply sources, usually diesel gas, or other liquid fossil fuels. However, in such applications the functioning of the system in harsh physical, climatic, or remote environments, and particularly with tight spatial demands available for the heating/cooling technology, places energy efficiency as low priority.

Another technique is so called free cooling which pumps a coolant from a cold source. The coolant then acts as a heat sink to cool an area.

For air conditioning buildings, and in particular for residential use, an increasingly important objective is to provide effective heating and/or cooling that is both efficient and cost effective. One such measure is the coefficient of performance (COP). COP relates to the ratio of heat energy generated by a device in relation to the amount of power supplied to that device. A good COP for heating and cooling using a conventional refrigerated air conditioning would be 4 to 5, but commonly above 3 for a total system. Evaporative air conditioning can operate at COP ranges of 10-15 and above but de-humidification does not occur with this process. In fact, humidity is often added in the cooling process that makes application of this type of system problematical in some locations. Therefore, most commercial applications tend to incorporate refrigerative heat pump systems in tandem, particularly in humid hot climates, reducing the COP. Temperate and dry hot climates use evaporative systems for single residential applications, but water use expense is now also becoming a problem in assessing viability.

A poor COP would be 1 or less. This is an issue for 'Peltier' or thermo electric cooling because the usual rate of cooling or heat supply needed for most conventional applications often leads to overloading the cells with electrical power. It is common for a Peltier cooling system to have 0.5 COP or less for cooling and less than 1.5 for heating. For example, Peltier cooling is used in armoured vehicles, where space and vibrations are key issues. The only way to get sufficient cooling power to keep operatives comfortable is to pump more diesel generated power into the system. Therefore the COP is greatly reduced to around 0.2 or 0.3. This can be justified for the use by the military but is not viable for residential cooling.

Currently, refrigerated systems are generally preferred, although in some areas evaporative systems are superior. A problem is that the costs to run such systems are increasing—even though the systems themselves are becoming more efficient. Power is more expensive to generate and these costs are increasingly being passed onto consumers. As costs increase the solution for many is to decrease the running time of air conditioners.

It is desirable to provide an improved air conditioning system that has a reasonable COP and cheaper running costs.

SUMMARY OF THE INVENTION

In a broad form, there is provided an air conditioning system utilising Peltier or Thermo electric cells to condition the air of a room. The system conditions the room by adjusting the thermal energy of air received from the room. This can be done by either removing or adding thermal energy depending on whether it is desired to cool or heat the room.

In another broad form, there is provided an improved heat exchange tunnel. The tunnel is generally circular in cross section and includes a plurality of ribs extending into the centre of the tunnel.

In a first aspect, there is provided an air conditioning module comprising:

a thermo electric cell having a first side and a second side;

an conditioning duct attached to said first side of said thermo electric cell; and an exhaust duct attached to said second side of said thermoelectric cell;

wherein said conditioning duct receives and conditions air from a room, and said exhaust duct vents unwanted thermal energy.

The first side of the thermo electric cell could be attached to a side wall of the air conditioning duct, and the second side of the thermo electric cell could be attached to a side wall of the exhaust duct. Preferably at least the attachment of the air conditioning duct to the first side of the thermo electric cell is via a thermal transfer block.

The air conditioning module can include at least one fan to generate air flow through the air conditioning duct and/or exhaust duct, and ideally each duct will have an individual fan.

The exhaust duct can receives air from a wall cavity.

In a second aspect the present invention provides an air conditioning system comprising:

at least one thermo electric cell, each cell having a first side and a second side;

a plurality of conditioning ducts attached to the first side of each thermo electric cell; and a plurality of exhaust ducts attached to the second side of each thermoelectric cell;

wherein each conditioning duct receives and conditions air from a room, and each exhaust duct vents unwanted thermal energy.

In a third aspect the present invention provides an improved heat exchange tunnel, wherein said tunnel is substantially circular in cross section and includes a plurality of ribs extending from the periphery of said tunnel towards the cross sectional centre of said tunnel, and wherein adjacent ribs alternate in length between a first length and a second length.

BRIEF DESCRIPTION OF THE DRAWINGS

An illustrative embodiment of the present invention will now be described with reference to the accompanying figures. Further features and advantages of the invention will also become apparent from the accompanying description.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

References in this document will be made to a Peltier cell, thermoelectric cell, or TEC. It will be understood that all three terms are interchangeable and are simply alternative terms of the same item.

A Peltier or thermoelectric cell is a cell capable of converting electrical energy, via a semi conductor, into heat energy. More specifically when an electrical current is applied, it provides cooling on one side of the cell while simultaneously heating on the opposite side of the cell. The cell is made up of semiconductors similar in configuration to photovoltaic cells except instead of solar energy activating the energy flow, it is the application of electricity that is converted in a reverse manner into heat energy (in the case of cooling being an absence of heat energy on the opposite side of the cell). They have had usage in internally cooling computers and used in the US military in armoured vehicles. At certain voltage/current supply to the cell there is a heat pump effect where like conventional air conditioning it is possible to generate more heating or cooling power than the electrical power supplied.

Figure 1:
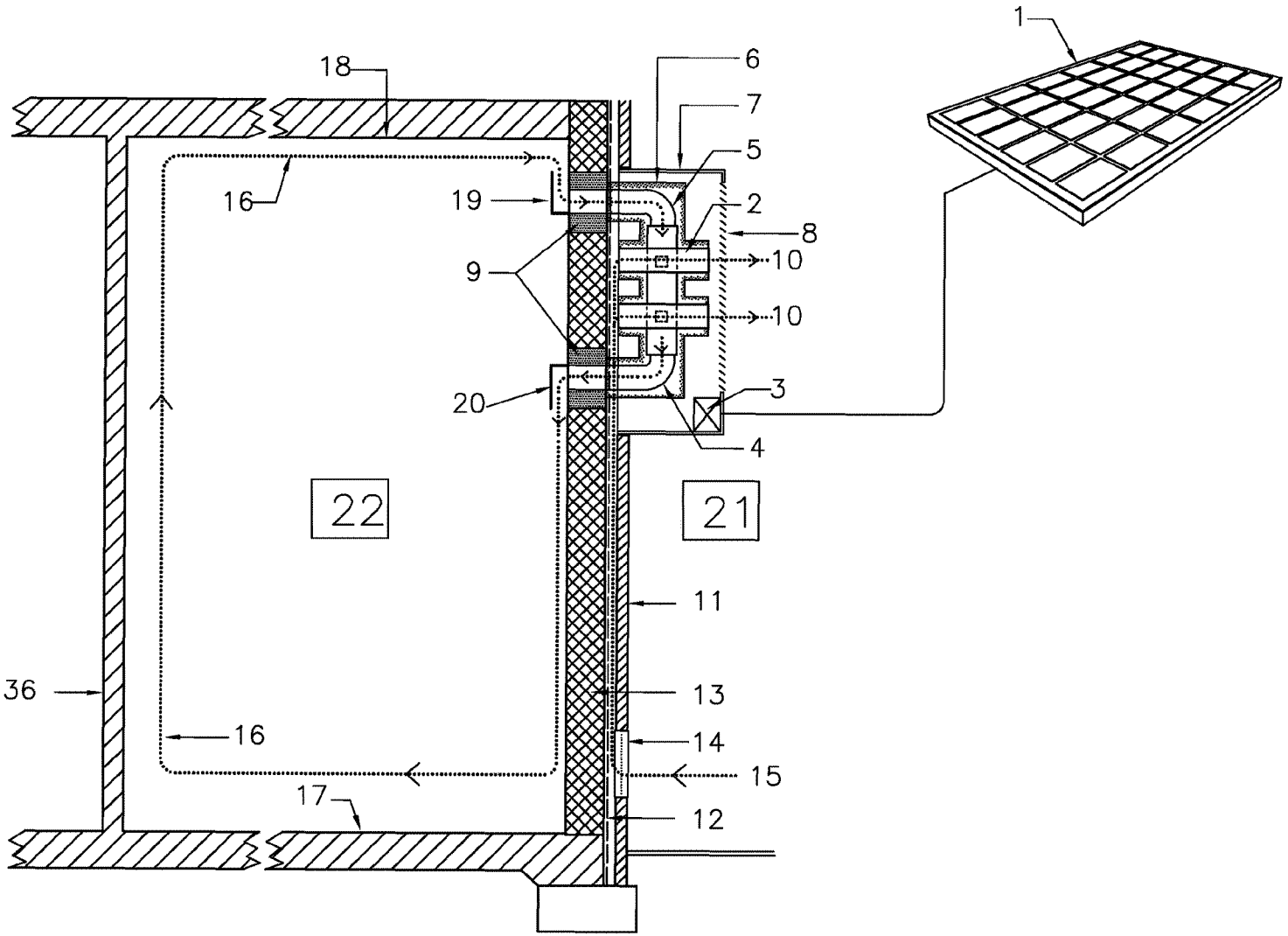
FIG. 1 shows a room with an air conditioning module of the present invention attached.

Referring to FIG. 1, there is shown a cross section through a room being cooled by an air conditioning module of the present invention. For simplicity of explanation the room has an exterior wall 11, 13, a floor 17, interior wall 36, and ceiling 18. The construction shows a standard cavity brick external wall that preferably faces a shady position in summer. The cavity wall is made up of the outer wall 11, inner wall 13, with the space between the outer 11 and inner 13 walls forming the cavity 12. For greater energy efficiency the cavity 12 may contain an insulating material. The internal walls 36 are preferably solid walls of mass materials, such as stone or concrete for example or new generation phase change infused lining boards in light weight framed wall structures, however a solid internal wall is not essential.

The air conditioning module of the present invention ideally penetrates through the exterior wall 11, 13 of a building. By entering through the exterior wall 11, 13, the module 2 can access the external wall cavity 12, which can be used to moderate the air drawn through the cavity 12 to the module 2. While utilising the cavity improves the COP it is not imperative. As an alternative, if desired, the module 2 could access the roof space of a building, or a cavity created by a false ceiling in the same way the preferred arrangement access the external wall cavity 12.

For cooling warm air is drawn in through return air baffle 19, ideally located near the ceiling, cooled by the module and then the cooled air is returned to the room via supply air baffle 20. In the preferred arrangement the supply air baffle 20 will direct the conditioned air along the inner wall 13 to enable the conditioned air to store its thermal energy in the mass and reradiate to the air. In this arrangement the system is mainly cooling the air through radiative effects and partially via some convection after this transitionary exchange with the mass surface of the wall. The wall could be lined with phase change impregnated board for lighter weight framed walls having a thermal mass effect enhanced to help with this primary thermal function of absorbing and radiating heat. With framed partitions this can help match the performance of heavy weight walls.

Alternatively, the supply air baffle 20 may direct the conditioned air into the room space in the same way conventional air conditioners do, however, it is considered that directing the conditioned air along the wall is significantly more effective. The preferred arrangement is exemplified in FIGS. 7*a* and 7*b*.

FIG. 7*a* shows the preferred arrangement whereby the conditioned air is pushed against the thermal mass of the room—the walls, floor and ceiling. The module will most likely only operate during sunlight hours when a photovoltaic panel is able to produce the DC electrical power. During the sunlight hours the thermal inertia of the mass continues to provide space conditioning to the room by radiation to air and occupants. Thus the system could condition the room space through a combination of direct air conditioning and radiated energy from the thermal mass.

FIG. 7*b*, shows a conventional air conditioner, with an external condenser 51 working with a fan and heat exchange unit 50 inside the room. The conventional air conditioner system pushes conditioned air into the room space to quickly raise or lower the air temperature as required. This allows occupants to feel an almost instantaneous effect. In many cases such systems are not normally active for long periods due to high energy consumption. In such conventional systems the thermal mass surrounding the room space would not have the opportunity to collect significant thermal inertia.

The return air baffle 19 and supply air baffle 20 ideally pass through plastic wall insert blocks 9. The blocks 9 can be moulded sections of polyurethane insulation that help hold the assembly in place in the wall and can also thermally isolate the ducts as they pass through the wall. Alternatively any foamed insulating material could be used in place of the blocks 9 but should have similar insulative properties to that of polyurethane.

The return air baffle 19 allows air to pass from the interior of the room 22 to return air duct 5. The air then passes into the module shown in FIG. 3, before returning in a cooled (or warmed) state back into the room 22 via the supply air duct 4.

An air exhaust 10 is provided to expel air warmed during the cooling process into the ambient conditions. The wall cavity 12 can provide the source of air for the heat rejection path of the cooling system. Fresh air can enter the wall cavity 12 via a fresh air intake vent 14 to provide the source of exhaust air. The path of the exhaust air can be seen as the path from item 15 to item 10 in FIG. 1. Preferably the air intake vent 14 is built or cut into the outer wall 11 at a low position so as to maximize the length of travel of air exhaust to the module. The length of travel of the air exhaust will be about 3 metres inside the cavity 12. The objective is for the external leaf 11 of the cavity wall to moderate the external air to coincide with the mass, or wall, temperature. This is achieved via transfer of heat energy from the air exhaust to the external leaf 11 of the cavity wall 11, 13, to enable added extra passive cooling to the exhaust tunnel and hence improve the efficiency of the reject heat side of the thermoelectric or Peltier cell. This can help to keep the hot and cold cells of the Peltier to below 10° C. and preferably less so the COP of the thermoelectric cell is around 3 or above in a steady flow condition. The reverse occurs in winter where the heat of the day adds heat to this exhaust path making it more effective in taking away cold temperature from the reverse polarity created cold side, thus improving the temperature difference in a steady flow condition while heating is occurring inside the conditioned room.

For this reason for optimal performance the external leaf 11 of the cavity wall 11, 13, would be shaded in summer and preferably in sun in winter. In summer cooling could start in the morning when night temperatures have naturally cooled the outer wall 11. In winter it would likely be better to commence heating at midday so as to give the direct sun and daytime temperature time to heat up the outer wall 11 as much as possible. The system will work without these conditions but will be more effective if properly considered at the design stage in locating where the modules are positioned in the layout on the external wall.

For better performance the module is housed in an insulation encasement 6. The encasement 6 should completely surround all the supply 25 and air exhaust 26 tunnels in the module. The encasement 6 assists in preventing, or at least inhibiting, heat from the air exhaust 10 being transferred to the supply 4, or return 5 air ducts.

In the preferred arrangement the supply air heat exchange tunnel 25, and extraction air heat exchange tunnel 26, are arranged at right angles in a cross path configuration. The junction of the two tunnels 25, 26 is where the Peltier cell 23 and thermal transfer block 24 are located.

Rather than right angles, the tunnels could alternatively be arranged between 30° and 90° and still have thermal viability. Right angles is however preferred as it minimises heat energy transfers.

For better security and strength, the insulation encasement 6 can be further surrounded by a metal box enclosure 7. The box enclosure 7 can provide weather protection of the encasing insulation sections that hold the tunnels in place. It can also provide a barrier to insects such as ants nesting in the insulation encasement. The box 7 could include removable louvers or grill 8 to allow access to the module. The grill 8 can also double as an outlet for the exhaust air.

In the preferred embodiment the module would also include a module control system 3. The control system 3 can control the times of heating and cooling periods and could monitor temperatures to divert PV energy into the grid connected system when the desired internal temperature in the room is achieved. The control system 3 should also track the temperatures of the cells so they do not overheat and fail. Thus a shut off function should be included to prevent the potential destruction of the Peltier cell due to overheating. Also the control system 3 should vary the voltage and current to ensure the correct amount of power is always delivered to the Peltier cell to suit the climate and temperature conditions of the day and whether hot or cold air is needed for the supply system.

The control system 3 could control the speed of the fans, times of operation, voltage, and amperage supply for various climatic/weather conditions. The control system 3, and module generally, could be connected to a photovoltaic panel 1. Alternatively power could be drawn from the mains or other alternative means such as wind or diesel generators for example.

Figure 2:
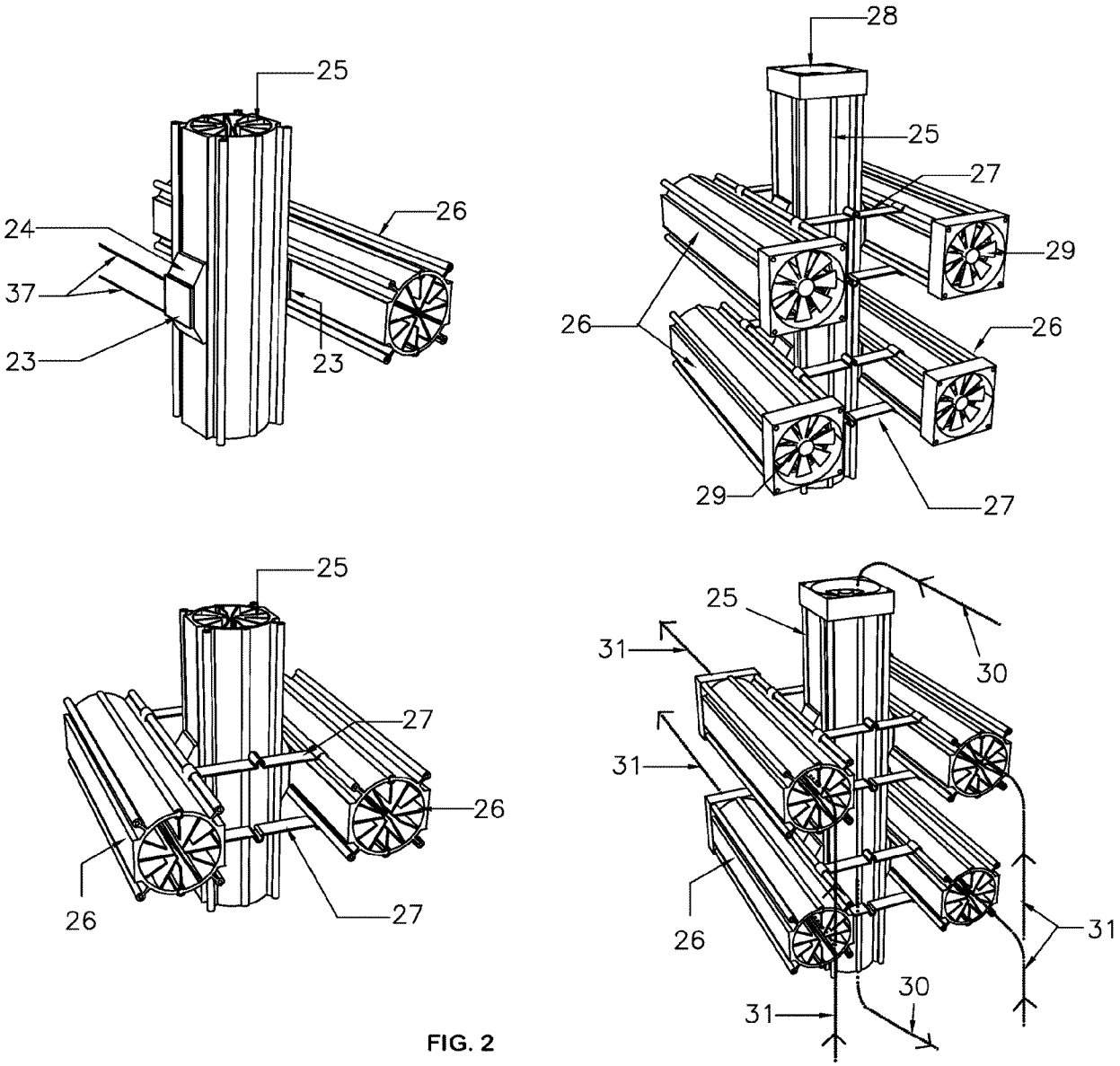
FIG. 2 shows the construction and arrangement of the heat exchange tunnels.

Turning to FIG. 2, the construction and concept of the module can be seen. The Peltier cell 23 is preferably mounted on a thermal transfer block 24 to increase the insulation value between the hot and cold sides of the cell. In an alternative the transfer block 24 could be integral with the tunnel 25, 26, although it is expected that this alternative arrangement may not be as cost effective.

The preferred transfer block 24 will take the shape of a trapezium. The Applicant considers that the trapezium shape better transfers the energy emanating from the square Peltier cell to the longitudinal running tunnel connecting to the thickened rib of aluminium, and ensures the most efficient conductivity along the sides of the tunnels into the perimeter of the basic circular shape and then in turn into the fins with the mass of material reducing as the energy finally conducted to the extremities of the tapering fins inside the tunnels. The shape ensures greater conductivity to the inside surface area of each tunnel, including the surface area of the fins. The transfer block 24 is attached to supply air heat exchange tunnel 25. While not essential in some embodiments the opposite side of the Peltier 23 could be mounted to another thermal transfer block that is joined to the extraction air heat exchange tunnel 26. In the arrangement shown, the Peltier 23 is configured to cool the supply air heat exchange tunnel 25, via the thermal transfer block 24. In generating the cooling effect on one supply tunnel side of the Peltier 23 the opposite side generates heat. This heat is passed to the extraction air heat exchange tunnel 26 to be dissipated.

This gap created between tunnels allows a viable thickness of aluminium at the critical cross path connection junctions at the cells. The aim is for the mass of aluminium to enable the heat energy being generated by the Peltier cell to be diffused away from the cell as quick as possible, and in turn at a maximum rate into the tunnel with its thickened side to continue the maximum rate of conductance into the internal surfaces of the tunnel.

The volume of the trapezium block should be such that the diffused thermal energy absorbed from the cell conducts at the maximum possible rate and distributes it to the connecting tunnel via an increased surface area greater than that of the cell alone. The trapezium shape ensures that nearly twice the surface area of aluminium adjoins the supply air tunnel to ensure there is no extra thermal resistance created beyond that of the actual resistance expected of the aluminium material itself at the expected range of temperature differences. As such this does not increase the temperature inside the block on the way to the supply tunnels beyond that generated by the cell itself. This ensures that as thermal energy is generated it is conducted away at a fast rate. The governing factor of the transfer into the air is then determined by the thermal resistance of the moving air itself inside the tunnel colliding with the inside surface area of the tunnel and the fins transferring the thermal energy into the moving air. The velocity of the air is preferably specially selected and controlled for maximum efficiency needed to maximize the COP of the total assembly in varying Climatic and thermal load conditions.

Other materials such as copper and other alloys could be used instead of aluminium if preferred. The objective is to ensure the efficient diffusion of heat. Copper could marginally improve the conductivity of the tunnels but the trade off would be increased cost.

The preferred arrangement will include a thermal transfer block between the Peltier cell and supply tunnel. An alternative embodiment could also include a thermal transfer block between the Peltier cell and exhaust tunnel, although it is expected that this will not be required in most applications. As the preferred arrangement includes two exhaust tunnels for a single supply tunnel the transfer block is not generally needed on the exhaust tunnels. In addition the inclusion of the transfer block on the supply tunnels increases the distance between the hot and cold tunnels thus improving the insulation between them. A single transfer block is expected to provide sufficient insulation separation.

The supply air heat exchange tunnel 25 includes at least one supply fan 28 to draw the air from the return air duct 5, and pass the air down the supply air tunnel 25 to be cooled. The fan is located at the top of the tunnel 25, however, it will be understood that the fan could be located along the tunnel or at the end of the tunnel. Alternatively a plurality of fans could be employed spaced along the tunnel. It is expected however that a single fan will be sufficient for most installations, and avoids the need for increased cost of extra fan(s).

A similar arrangement is on the extraction air heat exchange tunnel 26, whereby an extraction fan 29 is located at one end of the tunnel 26. Again it will be understood that the fan 29 could be located along the tunnel or at the opposite end, and could include multiple fans.

The objective of both the supply fan 28, and extraction fan 29, is to move air along the path of the respective heat exchange tunnels 25, 26 so as to better facilitate the transfer of heat.

Each tunnel should have low energy consumption requirements and could work on either AC or DC power, although DC power is preferred for at least the Peltier cells. AC seems a more reliable solution for supply as it enables off peak night hours use, and also use in extreme weather conditions if required. However, DC during daylight hours should be sufficient in most situations. The off-peak AC alternative, where available, could be an 'add-on' to the basic DC system if needed or required by the end customer.

Rather than an individual fan in each tunnel, the system could employ a single air supply, or a reduced number of fans, to move the air trough the tunnels. For example a single fan located in the return air baffle 19 could draw air into the module which would then be forced through the tunnels. However, the use of individual fans instead of a single air supply or exhaust fan, ensures greatest control, lowest noise and less dependency in the case of a particular fan failure.

In the preferred arrangement tension straps 27 or similar device are included to better secure the tunnels and prevent movement. The Applicant prefers to use spring clips to also ensure the correct compression. A compression range of 0.5 to 1 N of force across the area abutting the Peltier cell is preferably held against the junctions with the cells held in place by locating ribs in each tunnel and thermal conductance paste. This has an added benefit of reducing conductance losses between the cells and the tunnels. The use of suitable spring clips is expected to result in negligible, if any, conductance loss. Except for being attached to the thermal transfer block 24, the supply air tunnel 25 and extraction air tunnel 26 should be thermally isolated from one another. That is, the supply air tunnel 25 and extraction air tunnel 26, do not come into contact with one another, enabling efficient operation of the module.

Because of the limited contact between the supply air tunnel 25 and extraction air tunnel 26, the tension straps 27 are able to better secure the tunnels against any movement or vibration. Various alternative mechanisms could be used in place of the tension straps 27, for example straps made out of spring steel with a centralised crimp is one way of doing it or a threaded joint tightened to give the correct compression during assembly is another way of achieving the result specified. The tension straps can be configured a number of ways but need to be strong. They do not need to be insulating as they connect from like sides ether hot reject tunnels or cold if reverse polarity is used. The clips are encased into the insulation and kept clear of the supply tunnels (hot or cold whatever the case maybe in use) and thus insulating the clips from any influence of thermal bridging between hot and cold tunnels.

It will be appreciated that the insulation encasement 6 could be used to prevent, or reduce, movement of the tunnels, thereby removing the need for the tension straps 27 in some applications.

Supply air baffle 20 is configured to deflect the cooler air down the side of the inner wall 13, both acting to cool the inner wall and start the circular air flow (shown as 16 in FIG. 1) in the room for optimum operation.

That is, warm air is drawn from near the ceiling level moved down through the vertical tunnels of the module and discharged back into the room after cooling (in summer) and heating (in winter) during daylight hours, or potentially continually if a power source is provided. The air supplied towards the floor 17 creates a convection current 16 that helps distribute the conditioned air stream into a room, firstly down the primary mass wall 13, then the floor 17 up the opposite or interior wall 36 and across the ceiling 18. The air is then ready for another cycle of conditioning.

Figure 3:
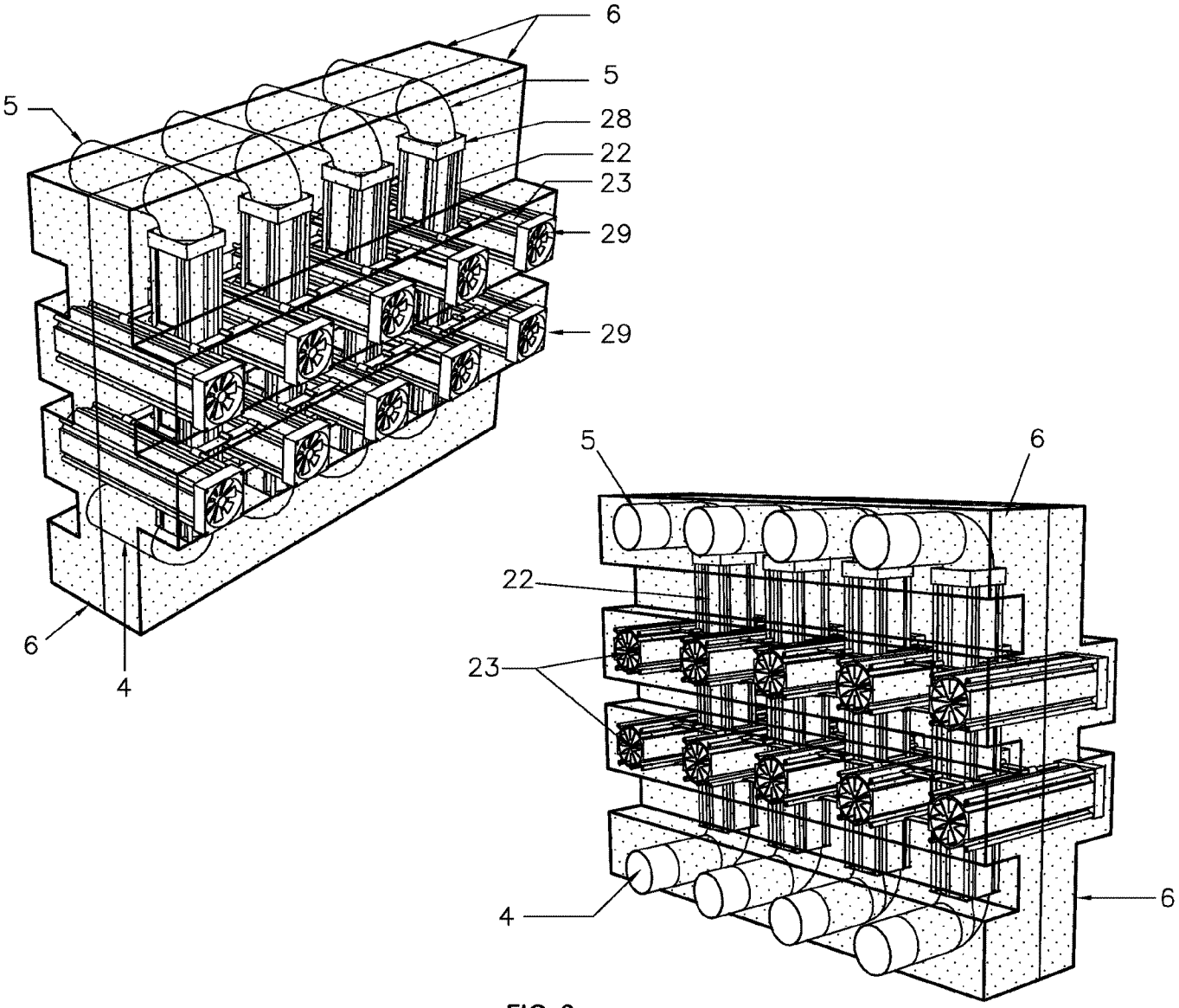
FIG. 3 shows a possible arrangement of the air conditioning module.

The module can be seen in more detail in FIG. 3. It can be seen that the module is made up of a series of supply air tunnels 22 housing two exhaust tunnels 4, 5 (one each side of the vertical supply air tunnel). The module size in most instances can range from 2 up to 7 supply air tunnels 22 normally but can be repeated to engineers' requirements. In FIG. 3 it can been seen that the module shown has four supply air tunnels. The array of tunnels can be clipped together and ideally encapsulated and held in place by two sections of shared or moulded polyurethane insulation 6 as shown by the dotted areas on the diagram. The aim of the insulation is to allow optimal operation of the module by isolating each of the parts from thermal interference by another part. Preferably the supply tunnels are aluminium and connected top and bottom at right angles by bent PVC plastic pipes which are encased by the mounded insulation encasement. PVC is advantageous as standard plumbing fittings could be adapted for use, however other plastic could be used provided it had the structural strength equivalent, or better, to PVC.

As shown in FIG. 2, fans 28 are attached to the top of each supply tunnel to ensure air is moved through the tunnel at the preferred speed. The applicant prefers magnetic bearing fans as they should reduce power supply requirements compared to other alternative options such as Sleeve Bearings, Ball Bearings or Fluid Bearings, and effectively reduce friction and noise issues. The rotor is maintained in place through the use of magnetic force meaning no contact between the shaft and stator, hence the lower noise. Also as a result lubricant is not needed removing loss of oil as a possible reason for failure. Further it is expected that the small magnetic bearing should have an extremely long life and be very cost effective. They also ensure very well distributed air flows in the tunnels to achieve good heat transfers into the set speeds of the moving air.

Alternatively, rather than a separate fan for each tunnel, a single fan could be used for the supply tunnels, and a single fan for the exhaust tunnels, could be used. However, this would require a manifold and additional controls to ensure the desired air flow rate in each tunnel was provided.

An added advantage of using a separate small fan in each tunnel is that if one fan malfunctions the system will continue to work. Separate fans also allow for the air flow in each tunnel to be more simply controlled as there is a direct relationship between the fan and air flow in the tunnel.

The special 12 v fans are to supply the air at 0.7 l/s up to 12 l/s for optimum heat transfer. Preferably these are variable speed fans controlled by a specially designed controller 3 located in the metal box 7 encasing the assembly module. The controller 3 could also divert PV power back into the grid connected system when not being used if applicable. This will happen when the room/mass temperature reaches 24° C. or whatever comfort temperature selected by the householder. Alternatively the system may have a pre-set comfort temperature.

If desired access for fan replacements could be included via a lift off grille 8 and then removal of the externally facing moulded insulation section 6, if ever needed. Theoretically however the preferred magnetic bearing fans should last twice as long as the product itself.

The exhaust air or extraction fans 29 are preferably located just inside the external grille so as to be readily accessible for cleaning and maintenance.

In the preferred arrangements the supply tunnels 22 can be between 350 mm and 650 mm long, with the applicants preferred supply tunnel being 500 mm long. For convenience the diameter of the supply tunnel 22 will be 80 mm so as to suit a standard fan size chosen for the module. If alternative fans are selected then the diameter can change accordingly, for example, some other common axial fan diameters are 92 mm, 120 mm, 140 mm & 200 mm. As long as the proportions are maintained in the ranges submitted then the diameter of the tunnels can be scaled up or down The wall thickness of the supply tunnel is preferably around 3.5 mm when the tunnel diameter is 80 mm. This is to facilitate fast transfer of the cell thermal energy by allowing the thermal energy to pass through the trapezium transfer block 24, the side thickening and into the tapering fins 70, 71. By conducting quickly from the Peltier cell 23, and providing an even spread of thermal energy through the tunnel 25, 26, efficient heat transfer is enabled. Ideally the tunnel will include tapering fins 70, 71 as shown.

The side fins or thickenings on the outside of the tunnel 25, 26, are part of the tunnel extrusions, and improve conduction down the length of the tunnel 25, 26. While a tunnel could be provided without fins, the supply air tunnels 22 are devised for optimal surface area inside so as to maximise the heat transfer from the cell 23 to the air along the length of the tunnel 22.

In the preferred arrangement the large fins 70 are about 32×2×1 mm tapering shape, and the small fins 71 are about 23×1.5×1 mm tapering shape. Variations of +/−5% on each proportion could be incorporated. There are smaller and longer fins added to increase the number of fins radially positioned without unduly increasing the air resistance in the tunnel.

The preferred dimensions of the tunnel have two advantages. The 80 mm diameter happens to perfectly suit commonly made axial fans previously used in computer cooling, avoiding the need for customised fans. It also is practical to deliver the air flow volume to heat and cool the air when combined in an array of supply and exhaust tunnels giving approximately 0.5 to 1 ACH (Air Change per Hour) room air change through the system. in the preferred arrangement there are twelve tapering fins 70, 71 inside each tunnel 25, 26 that endeavour to maximize the thermal transfer of the tunnel without exponentially increasing the air resistance and thus increase the air pressure needed to be supplied by the low energy fans.

The preferred arrangement has adopted alternate length fins 70, 71, to ensure maximum reach towards the centre of the tunnel while keeping the chambers between the fins 70, 71 open near the centre to facilitate a lower pressure requirement of the tunnel fan 28, and allow the air to flow as a single air volume. The number of fans and its reach inside the tunnels seeks to maximise the surface area with minimal increase in air pressure of the fan needed to affect the best heat transfer rate to or from the moving air at the selected speed.

The air exhaust tunnels 26 are between 200 mm and 400 mm long, and preferably 250 mm long. In the preferred arrangement the exhaust tunnel is the same thickness as the supply tunnels and made out of the same extrusion profile, and has an outside diameter of 80 mm again to suit the selected standard axial fan chosen for the module. Preferably the exhaust tunnel 26 will also include fins, and ideally the large fins are 32×2×1 mm tapering shape, and the small fins are 23×1.5×1 mm tapering shape.

The system could be scaled up (or down) in the proportions indicated by these dimensions to provide the same configurations for smaller or larger buildings if desired.

The ratio of: Supply tunnel 25 length:Exhaust tunnel 26 length: Tunnels 25, 26 outside diameter:Thermal transfer block 24 thickness:Tunnel 25, 26 thickening overall thickness being the side thickening of the tunnel extrusion to allow connections to the TECs and help conduct along the length emanating from the junctions:Thermoelectric cell 23 housing width;

Should ideally be=500:250:80:25:6:40

Or more simply=50:25:8:2.5:0.6:4

However allowing for fine tuning to various climatic conditions the ratios can be proportioned within ranges as follows as a universal guide for the module 2:

(40-60):(15-35):(5-15):(1-5):(0.2-1:2-6)

Figure 5:
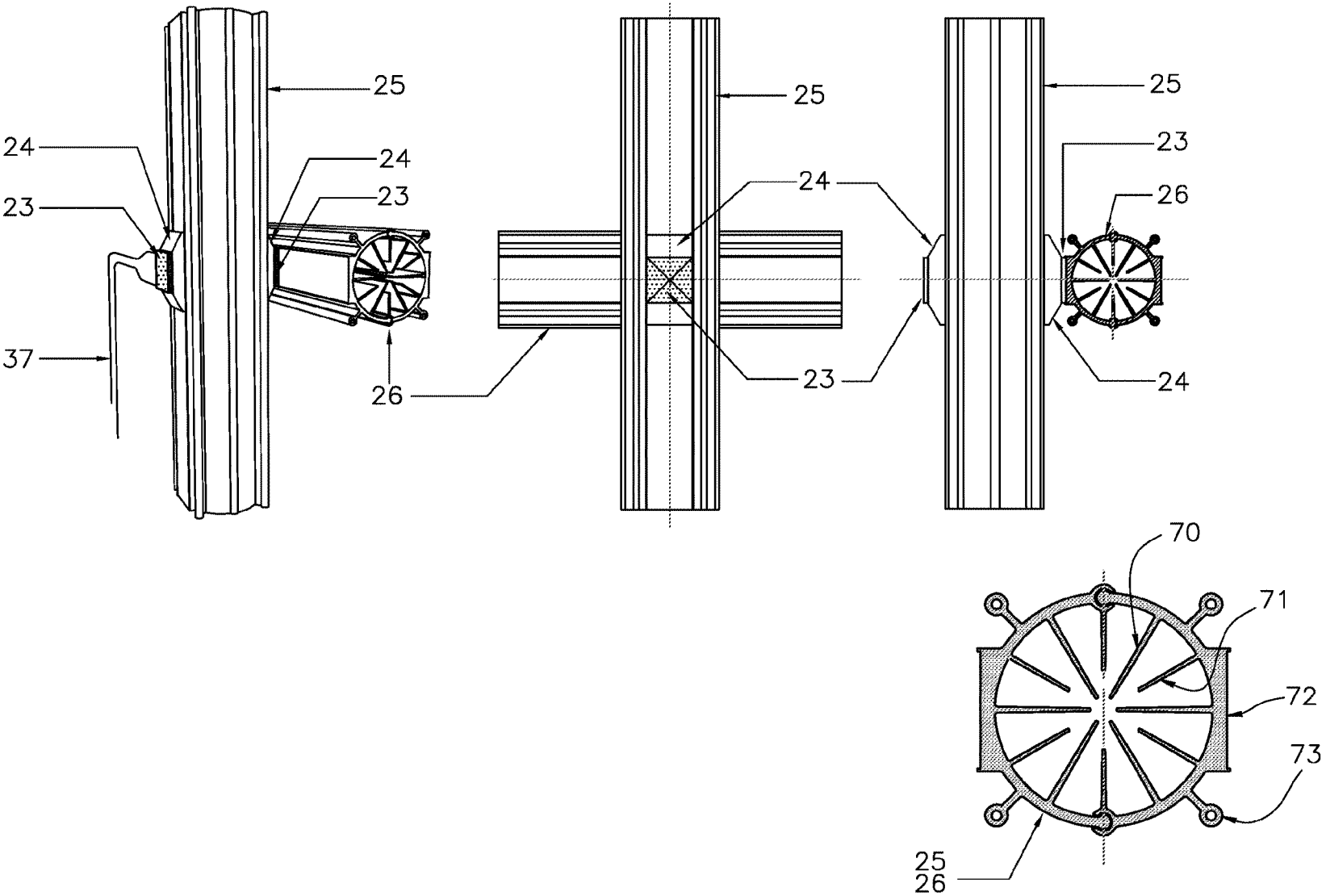
FIG. 5 shows one arrangement of the Peltier cells and heat sink tunnels.

The energy may be supplied by a junction/controller that provides electricity to the TECs or 'Peltier' cells 23 located between the vertical aluminium supply tunnel 25 and the horizontal exhaust air tunnels 26. This is exemplified in FIG. 5 where DC Power wiring 37 is shown going to Peltier 23.

The exhaust air tunnels 26 draw air from the cavity 12. Ideally, for new builds there will be a minimum of 25 mm air cavity from any insulation built up against the inner wall 13 and the inside surface of the outer wall 11. This ensures that the inside thermal inertia helping the inside temperature of the space is isolated from the exhaust path. The outer wall 11 relating to the exhaust side of the system functions partly by moderating the temperature of external air 21 from the outer wall 11 on the way. This happens by the air passing the inside surface of the outer wall 11. Insulation against the thicker inner wall 13 thermally isolates the inner wall 13 from this type of thermal transfer. This exhaust air takes the reject hot air in summer and cold air in winter away from the TECs efficiently maximising the COP in the process. By lowering the incoming external air temperature through the cavity the temperature on the hot side in summer is kept cooler in a steady flow situation, lowering the temperature difference of both side of the cell and thus helping to increase the COP. With winter heating the exhaust side becomes the exhaust side and the daytime warming of the external leaf results in warmer exhaust against the cold side and therefore increasing the COP as well when the polarity is reverse for supply side heating.

Special pelmets at the intakes 19 and supply outlets 20 direct the air in the correct direction to maximise the mass/air thermal exchange as well as enable the openings of the intakes 19 and outlets 20 inside the room to be aesthetically concealed.

Each tunnel has its own axial fan to supply the air downwards for the conditioned air in the room as well as the exhaust air tunnels expelling the air back outside. This happens after the mass moderated cavity exchange, delivering a more beneficial temperature exhaust air to the reject side of the TECs.

A removable grille, if included, allows cleaning and maintenance access to the fans and tunnels, which should actually be encased into an insulated housing.

In the preferred arrangement the heat exchange tunnels 25, 26, will be circular for better efficiencies. A circular tubular shaped tunnel 25, 26 ensures the smallest external surface area to the maximum air volume, ensuring heat losses from the tunnels 25, 26 into the insulation 6 are as small as possible. Since the tunnels 25, 26 are circular the air flow is even across the cross section of the tunnel 25, 26 distributing air evenly across the inside surface and fins 70, 71, to maximize the thermal transfers while minimizing corresponding air resistance. The tunnels can have the same profile that fits the radius of the preferred high efficiency, long life magnetic bearing type axial fans 28, 29.

The preferred profile includes a side wall thickening that provides extra material in the form of some extra mass of aluminium in the extrusion to help in conducting energy for each side of the alternating cooling and heating sides of the Peltier 23, so that the energy is diffused rapidly into each tunnel 25, 26 and quickly transferred to the moving air via the tunnels 25, 26 radially oriented fins 70, 71. The thickening on the sides of each tunnel allows a rectilinear connectivity of the cell to the tunnels. The extra mass can be sized to provide the right volume of aluminium to diffuse the energy from the reject side of the system to affect the right amount of diffusivity of thermal energy so as not to inhibit the flow rate of the thermal energy in the aluminium to the passing air inside the tunnel. This thickening can be effective as part of an extrusion for the heat reject path of the system. On the supply path the trapezium block enhances this diffusion of thermal energy inside the tunnel as previously described. The extra wall thickening on the sides provides the correct volume of material generated by the width, length and thickness of the aluminium incorporated into the extrusion of the tunnel to the above specified proportions. This is devised to diffuse the thermal energy along the entire length of each tunnel being initially transferred from the Peltier cell for the exhaust tunnel as well as on the other side of the cell to the trapezium blocking piece connector to the cell and the supply tunnel. It is expected that the refinement of the volume of aluminium required in the preferred design could reduce the volume of aluminium required by up to 50% compared to some standard proprietary heat sinks.

The circular shape gives the tunnels minimum external surface area to volume of air ratio and at the speeds selected for efficient heat transfer gives the tunnels efficient results, especially as the internal fins increase the internal tunnel surface area.

The design of the present inventions enables up to 50% less aluminium to be used with no (or minimal) fall off in heat energy diffusion especially at the design speeds selected for the heating and cooling functions of the system.

The heat exchange tunnels connect through to the room space 22 via plastic ducts that slot through foamed plastic inserts 9 built into the wall 11, 13. A removable external grille 8 and strategically placed control box 3 enables access to the cells 23 and fans 28, 29 for repairs and replacements that may be needed over time.

Figure 4:
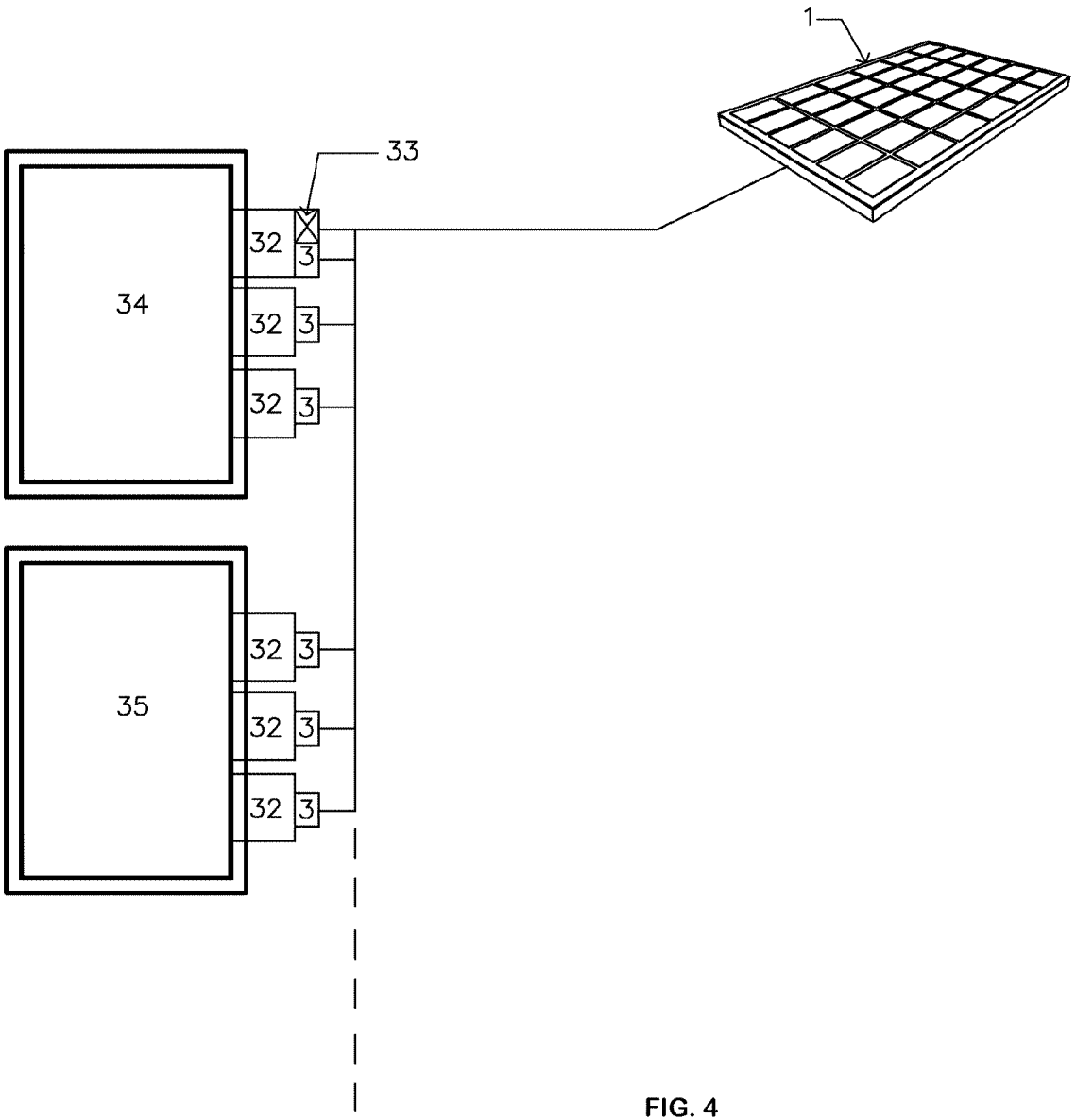
FIG. 4 shows an example of a possible installation of the present invention.

The module could be powered by a variety of photovoltaic or with both AC and DC connections and configurations, however, the applicants are seeking a preference to use one 320 W/PV panel 1 or that proportion of a larger PV array that would provide, over daylight hours, supplementary cooling or heating to a 6 m×4 m×3 m standard room size. For larger rooms or spaces additional modules or expansion of the module itself, plus increasing the PV supply would be utilized. FIG. 4 provides and installation overview.

In the example of FIG. 4, two rooms 34, 35 are shown, although it will be understood that additional rooms could be added in the same manner. Both rooms 34, 35 are configured with three modules 32 to provide sufficient cooling/heating. The diagram indicates that it is possible to use one or multiple modules to cool or heat a space connecting with a common controller. The modules 32 are each controlled by a module control system 3, and in the arrangement shown there is also included a master control system 33. The master control 33 could look at the overall thermal and energy efficiency of the entire building and direct energy to the space or zone to ensure total building comfort and energy efficiency. It could also direct the correct amount of power from a PV array either DC or via an inverter. The control systems 3, 33, and the Peltier cell 23 can be powered by solar photovoltaic panels 1 located on the roof of the building, or an alternative location that receives sufficient sunlight.

Figure 6:
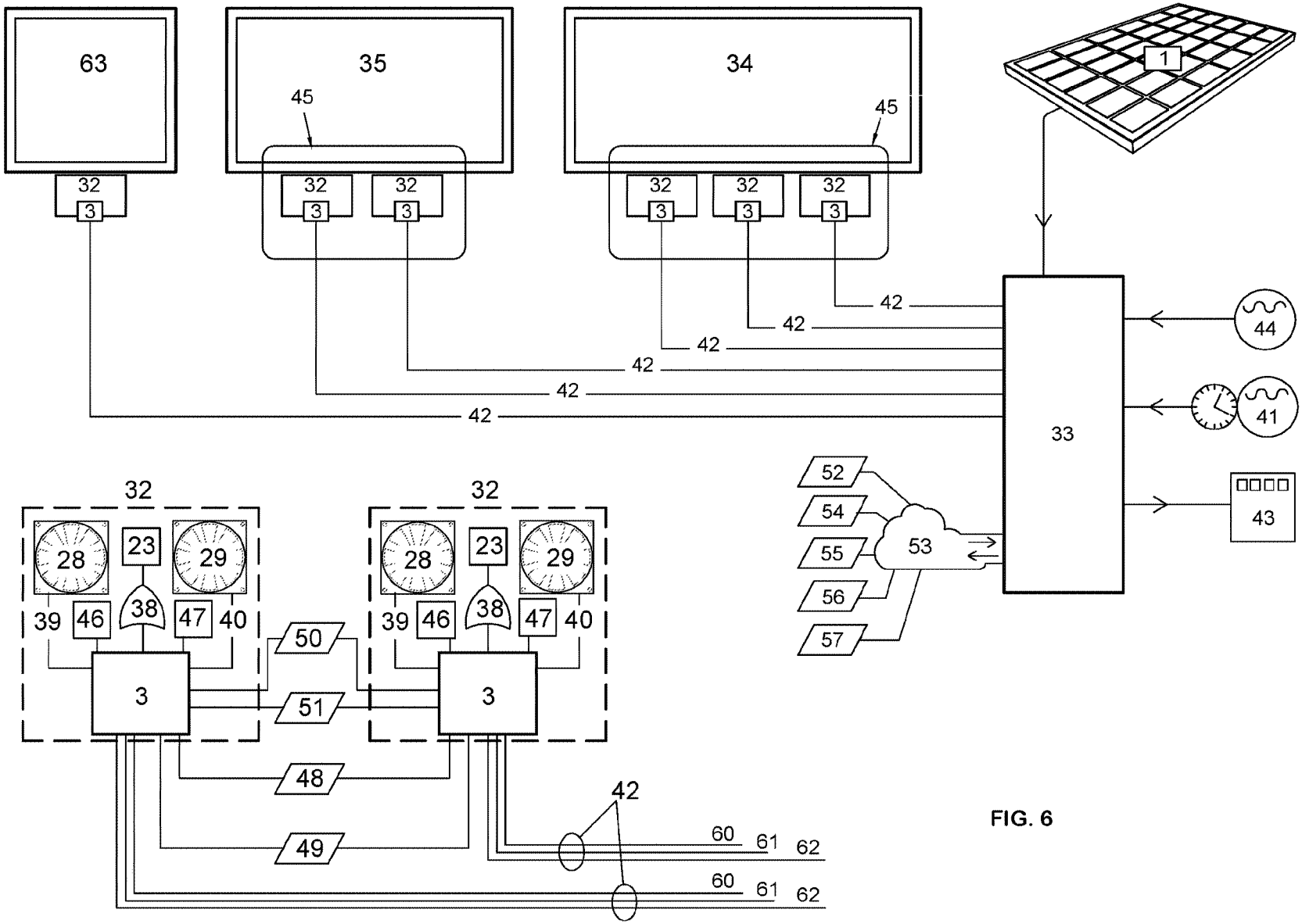
FIG. 6 shows an exemplary control arrangement for one embodiment of the present invention.

The preferred arrangement is exemplified in FIG. 6. FIG. 6 shows three rooms 34, 35, 63. In room 63 a single air conditioning module 32 in accordance with the present invention is used. For room 35 it has been decided to use two modules and for room 34 three modules. The number of modules can be selected by taking into account the room volume, environmental factors such as location and whether walls are shaded or in full sun, and other requirements such as desired ambient room temperature.

Each of the modules 32 is ideally controlled by an individual controller 3, which itself may be controlled by a master control system 33. The individual controller 3 can regulate the power supply to the Peltier cells 23 and fans 28, 29, based on information provided by the master control system 33.

The master control system 33 can be powered by photovoltaic panels 1, and distribute power to each of the individual controllers 3. Power could be directed directly to the individual controllers however it is felt that routing power through the master control system 33 provides a simpler control mechanism. The power source may also be another alternative such as mains power 44 or a combination of renewable and non renewable sources. In some installations it may be warranted to include an AC off-peak boost 41. Such installations would likely also include a timer to control mains power consumption. Where applicable the system can also be configured to return surplus DC power to a DC/AC inverter 43 for use with other appliances or return to the grid.

Figure 7:
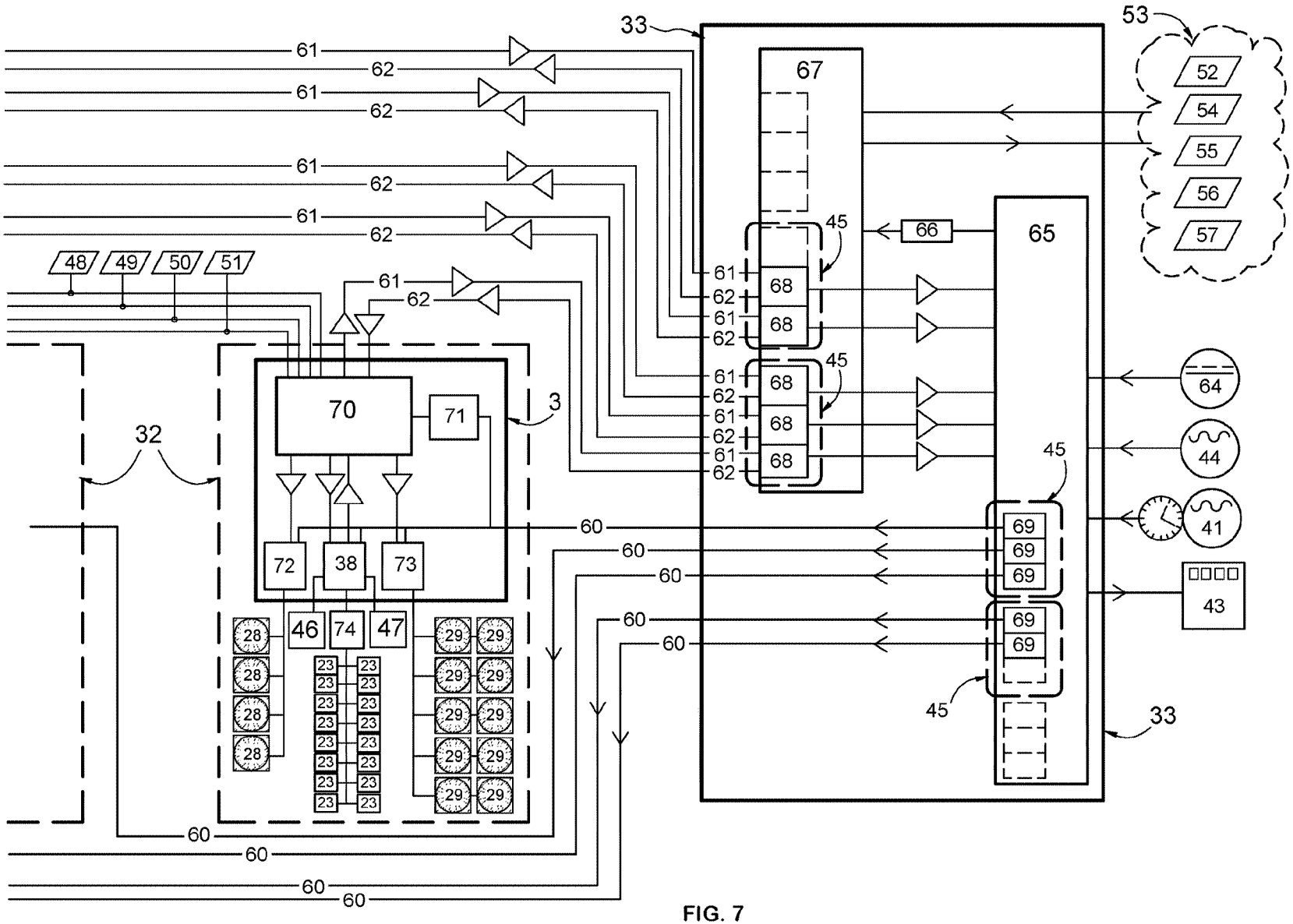
FIG. 7 shows a possible configuration of a control system.
Figure 8B:
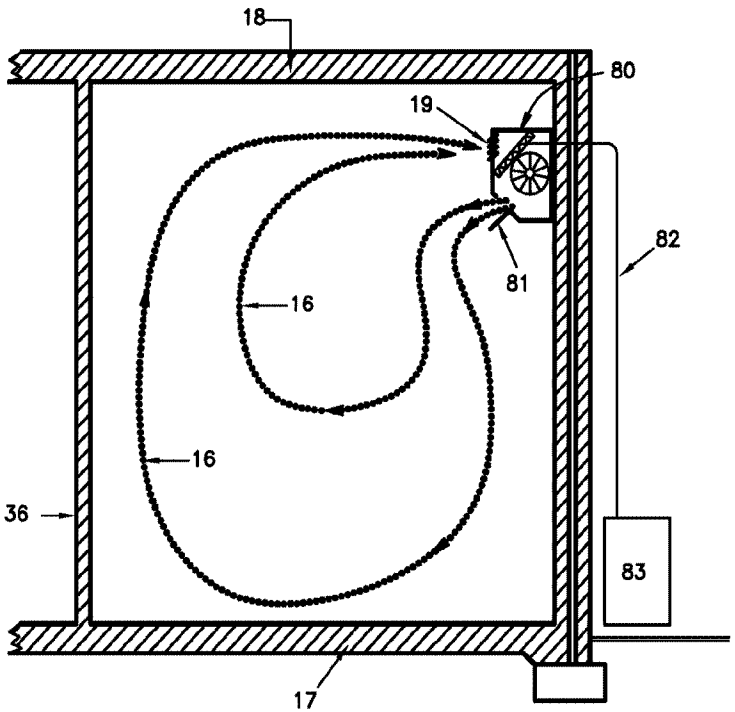
FIGS. 8*a* and 8*b* exemplify the conceptually different approach between the preferred embodiment of the present invention and conventional systems.
Figure 8A:
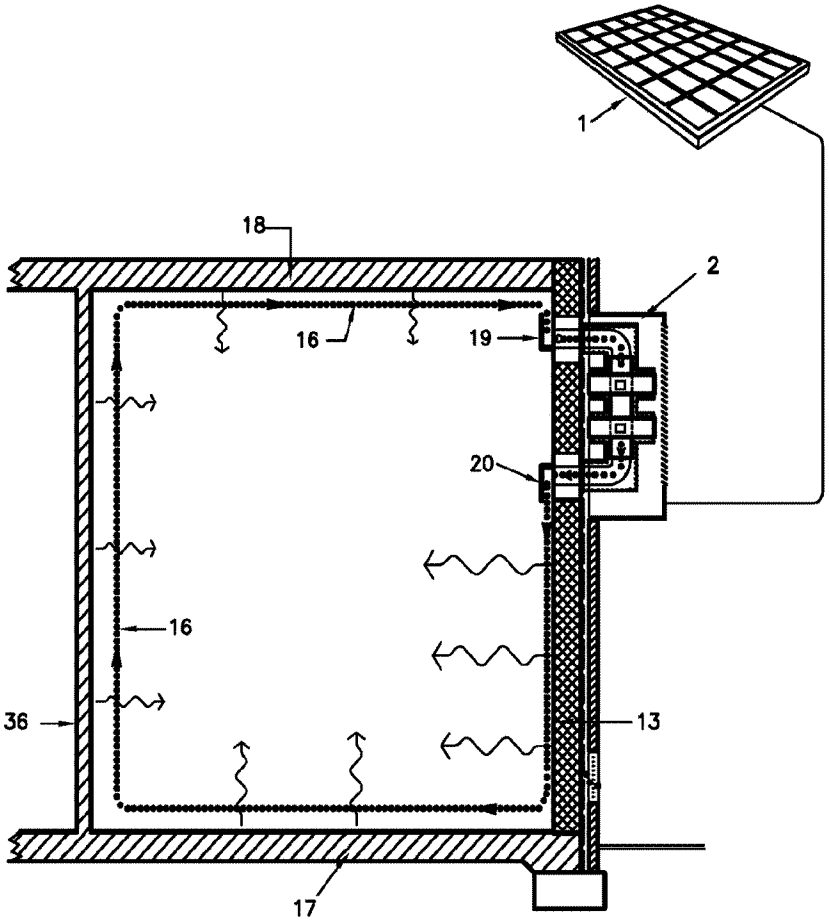

As shown in FIG. 7, the master control system 33 can include a system power controller 65 having a number of power controllers for each module 32 in the installation. The master control system 33 can also include a processor 67 with data and control processing 68 for each module 32.

The individual controller 3, can include a processor 70 powered by a power unit 71, which itself receives power from power controllers 69 in the master control systems 33. The processor 70 operates the supply fan voltage controller 72, and the exhaust fan voltage controller 73.

The system will also ideally include a temperature regulated safety power shutoff 74, which would operate to disable the Peltier cells 23 if temperature exceeds a predetermined threshold.

In the preferred arrangement the master control system 33 will provide power 60 to the individual controller 3, which would then distribute the power 39, 40, for the Peltier cells 23 and fans 28, 29, and control data 62 from the master control system 33 to the module 32. The modules 32 could also provide sensor information 61 back to the master control system 33. This sensor information could be obtained from various possible sensors such as Peltier cell first side temperature 46, Peltier cell second side temperature 47, room thermal mass temperature 48, room air temperature 49, external air temperature 50, or external wall temperature 51. It can be seen that in some cases the sensor reading would be common to a group of modules, and in other cases the sensor reading would be specific to a module. For example, room air temperature 49 would be common to all modules in that room, whereas the Peltier cell first side temperature would be specific to a single module.

The power from the individual controller 3 to the Peltier cell 23 would preferably pass through a voltage controller 38 which is able to reverse the polarity of the power depending on whether cooling or heating is required.

In general terms the system would sense the temperature and compare the sensed temperature with a required temperature. This would determine if the system needs to heat or cool and set the voltage polarity to the Peltier cell accordingly. Power would be sent to the Peltier cells to generate the cooling and heating effect, and also to the fans to produce the necessary air flow along the tunnels. The conditioned air leaves the module and passes along the thermal mass of the room to be re-radiated into the room.

The system may be preconfigured to maintain a predetermined ambient temperature, and/or operate during set times. It is expected however that most installation will include a user input interface 53 to allow the end user to control operation. Depending on the implementation the user could for example set the room temperature for each room or set the time of operation for each room. The interface 53 could be hard wired to the master control system 33 or accessible via a global computer network such as the Internet.

Ideally, the interface 53 would also access a link to a meteorological weather forecast 52. If the forecast is for a particular hot or cold period the system could be configured to pre-emptively adjust operation to account for the predicted weather. For example, if the forecast was for a particularly hot day the system could begin cooling the thermal mass of the room so as to limit the effect of the upcoming hot weather.

The cavity on summer days becomes the cooling path for the exhaust air and a passive heat path for the reject cold air from the TEC. The cavity in winter in temperate type climates will always be around 13 deg C. to 15 deg C. (for passive pre-heating of external cold air which could easily be 7-10 deg C. in the mornings) and in summer 25 deg C. to 28 deg C. in most temperate climates (when outside air could be 26 deg c. to 45 deg C. throughout the day). Thus by time clocking through the controllers it could be possible to enhance the temperature of the external air being used for the exhaust/reject air function, being moderated through the external wall cavity.

Most buildings react poorly (energy efficiency-wise) but rather quickly in response to weather and climate changes. Conventional air conditioning systems deliver a high rate of heating and cooling power that the present invention does not seek to compete with. That is the present invention does not adopt the same strategy of heating or cooling in a quick response timeframe. However by utilizing thermal mass of a building in a different manner, quick responses diminish in importance to providing continuous comfort levels.

The present system works slowly over the full daylight hours when reliant on photovoltaic/preferably DC energy. Longer operation can be provided if a power source is also provided. Cool storage or heat is stored in the mass surrounding the space rather than attempting quick intermittent heating and cooling of the air within the space which is the traditional strategy. That is the present system is designed to operate through out the day so as to maintain a comfortable temperature, rather than only operating during high demand periods.

The system is suitable for passive solar buildings where the thermal mass has stored energy from the sun in winter, shielding using shade in summer and trapping the energy in winter at night or expelling via night ventilation in summer, greatly moderates the thermal mass temperature over 24 hours in a building.

Thermal mass can store thermal energy at an attractive rate without the need for storing electric energy in batteries then applying the energy at a later time to running heating and cooling after the sun is not directly available. Instead of electric storage the running of the present system during daylight hours enables the weather warmth or 'coolth' to be stored in the walls floors and ceiling soffits of the building itself, re-emitting thermal energy or absorbing heat in the case of cooling to keep temperature stable as night time tends to be lowering internal temperature through conductance through the building skin or via air infiltration and leakage.

In this way a stable temperature of about 24° C. is maintainable day and night simply by generating heat or cold as needed to bring the mass and air temperature to this target during daylight using the PV generated power. These benchmark temperatures suit temperate climate where 95% of the population of Australia lives. There are obviously different comfort temperatures applicable to tropical and frigid climates, but the operating principles are the same and either more or less modules would be applied to satisfy the comfort conditions and the available solar radiation during daylight hours through out the seasons. The same approach is applicable elsewhere in the world.

Through a system of cross path circular tunnels the heat exchange is transferred from the Peltier or thermo-electric cells to the air in an efficient manner improving the COP whether on a heating or cooling cycle.

As an example high viable COPs can be achieved from a DC connected PV source when:

The temperature difference between the hot and cold sides of the TEC is below 10° C. in a steady flow condition air from position (15) to (10) at say 20 to 28° C. meeting at the cross path position with the supply air via air path (16) at say 24-26° C. in summer.

The air temperature chosen for summer cooling criteria is kept below 28° C. most of the time in daylight hours by ventilation and night re-radiation of the external skin of the connected wall.

The air supply target is 24° C.

Night ventilation of the building pre-cools the interior to 28° C. maximum in summer and 18° C. min due to solar gains in winter, enabling the temperature difference to be kept down the vast majority of the time during daylight hours.

This system naturally can work with lower cooling and higher heating temperatures, but if the temperature difference in the TEC cell 23 itself exceeds 10° C. between the hot and cold sides in a steady flow condition then the COP will reduce and economic viability would suffer as an energy saving system.

The Peltier cell 23 provides cooling on one side of the cell 23, and heating on the other side of the cell 23. The selection as to which side is cooling and which heating can be determined by controlling the polarity of the power to the cell.

In the present application, if the system was in cooling mode, such that the cooling side of the Peltier cell 23 was connected to the supply tunnel 4, then the module could be switched to heating by reversing the polarity of the power to the cell 23. That is, when heating is required the controller 3 could through a solid state mechanism simply change the direction of the power to the Peltier cells 23. The supply tunnel 4 would simply then deliver heated air instead of cooled air. Conversely by this polarity change in the electrical supply the exhaust tunnel 10 would exhaust cold air instead of hot reject air normally exhausted when the cooling process is activated.

A switch could be included to allow a user to reverse the polarity of the electrical supply, and thus change from heating mode to cooling mode and vice versa. In the preferred arrangement a simple temperature condition monitored from inside and outside thermostats would trigger a decision in database and activation algorithms programmed into the sold state controller to either heat or cool on a particular day, especially mid season if abnormally hot or cold weather is experienced and starts to affect the temperature levels inside the building.

By simply switching polarity of power to the TECs, the system switches from air supply cooling to air supply heating and vice versa, through the cavity rejecting hot air in summer and cold air in winter.

The air conditioning module of the present invention provides a number of advantages over the more conventional refridgerative and evaporative air conditioners including:

A possible reduction of up to 50% in the capital cost of conventional heat pump type systems, and little if any ongoing maintenance costs as there are no moving parts apart from the long lasting small fans in the preferred system.

Elimination of the need for out-gassing associated with conventional AC systems thereby reducing the environmental impact of air conditioners.

Reduces the power demands for supplementary heating and cooling of buildings, particularly if photovoltaic cells are used to provide the power.

Enable thermal energy from the day to be stored in the fabric of the building reducing, if not eliminating the need for battery storage systems for nighttime building use.

Improves the expected COP in comparison to existing Peltier systems, and introduces high thermal efficiency and tunnel isolation to reduce the bleeding of heat from hot to cold sides of the cells.

Utilizes a new profile for the tunnel extrusions that increases the efficiency of the heat exchange. This is achieved through balancing the diffusion of energy through the mass of the tunnel to an ideal surface thickness and area of its radial fins. This maximizes the heat transfer from TEC to the optimized moving air in the supply and exhaust tunnels.

Reduces power demand so that a single PV panel via DC is capable of powering the system in off grid locations.

In addition the present invention is expected to achieve acceptable COPs. For example in temperate climates the module is expected to achieve the following COPs:

Summer Cooling: 3.0 in average conditions
0.5 to 1.0 in extreme conditions
4 to 5 in moderate conditions
Winter Heating: 9.0 in average conditions
1.0 to 1.5 in extreme conditions
10.0 to 12.0 in moderate conditions The present system could also be combined with conventional air conditioners. That is the present module could work in conjunction with other air conditioners in a hybrid format, providing heating and cooling in moderate conditions and saving energy, using thermal mass more directly when conditions allow, saving energy and operating costs intermittently. That is the present system could moderate temperatures, while the conventional system could provide the 'instantaneous' effect a user desires. The use of the present system would at least reduce the demands on the conventional system.

Broadly speaking the present invention provides an air conditioning system with a conventional heat pump replaced by a Peltier or Thermo electric cell, ideally powered by photo voltaic solar power. Unlike conventional systems the present system is intended to use a lower power source over a longer period of time, such as during daylight hours. The present system looks to moderate the power supply to the Peltier cell modules during daylight hours to cool a main wall in a room so as to cool or heat a space over daylight hours emanating from radiative thermal control rather than primarily heating and cooling the room or space in a building direct to the air of the space itself. However the convection flow from a conventional air conditioning system created in the room or space could assist in distributing the thermal conditioning as a secondary mechanism, after firstly distributing the air slowly to all the mass surfaces in that space (main wall, floor, side opposite and adjacent walls then the ceiling soffit as the air naturally rises ready for recycling.

Aside from the general application to air conditioning one aspect where the preferred embodiment of the present system is unique compared to other TEC systems, is that current systems use a packed parallel plate heat exchanger type system for heating and cooling. While such systems are good in tight enclosed spaces, thermal efficiency is sacrificed. The conventional arrangement creates some thermal losses in efficiency from thermal leaking from hot to cold sides, and also leads to extra thermal and electrical resistances in the cells themselves. This leads to even more power being needed to operate the TEC system to get the cooling or heating power needed. Rather than a parallel plate heat exchanger the present invention employs a cross path or perpendicular heat exchange arrangement, removing or at least reducing the thermal losses.

Incorporating crossed air flow is one unique feature of the preferred embodiment. However, if space is an issue, parallel vertical tunnels could be used as a variation to the cross path configuration, however care should be taken to ensure that the insulated gap created by the aluminum transfer block should be maintained throughout as a minimal distance between the tunnels. It is expected that a parallel configuration will result in a loss of COP compared to a crossed configuration due to increase heat transfer between the hot and cold tunnels that would likely occur.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment.

Furthermore, the particular features, structures, or characteristics may be combined in any suitable manner in one or more combinations. It will be appreciated that persons skilled in the art could implement the present invention in different ways to the one described above, and variations may be produced without departing from its spirit and scope.

Any discussion of documents, devices, acts or knowledge in this specification is included to explain the context of the invention. It should not be taken as an admission that any of the material forms part of the prior art base or the common general knowledge in the relevant art, in any country, on or before the filing date of the patent application to which the present specification pertains.

The invention claimed is:

1. An air conditioning system comprising:

a cavity wall comprising:

an inner wall;

an outer wall, the inner and the outer wall being spaced apart to form a cavity; and an air conditioning module mounted to the cavity wall, the air conditioning module comprising:

a thermo electric cell having a first side and a second side, the thermo electric cell being operable to maintain a temperature difference between the first side and the second side;

a supply tunnel wall defining a supply air heat exchange tunnel, wherein the supply air heat exchange tunnel is configured to receive and condition air from a room to produce conditioned air, and wherein the supply tunnel wall is configured to be connected to the first side of the thermo electric cell;

a first portion of the supply tunnel wall that is configured to be connected to the thermo electric cell having a greater thickness than a second portion of the supply tunnel wall that is not configured to be connected to the thermo electric cell;

a supply air duct configured to receive the conditioned air from the supply air heat exchange tunnel, the supply air duct extending through the outer wall and being fluidly isolated from the cavity;

a supply air baffle extending through at least part of the inner wall, the supply air baffle being fluidly isolated from the cavity, and configured to be fluidly connected to the supply the air duct and to direct the conditioned air from the supply air duct in a direction parallel to the inner wall, thereby enabling an exchange of thermal energy between the conditioned air and the inner wall, along the inner wall; and an extraction tunnel wall defining an extraction air heat exchange tunnel that is fluidly connected to the cavity, the extraction tunnel wall being configured to be connected to the second side of the thermo electric cell, wherein the extraction tunnel wall is configured to receive air from the cavity, to enable thermal energy to be transferred from the thermo electric cell to the received air, and to enable the received air to be vented, thereby venting unwanted thermal energy, wherein the supply air heat exchange tunnel is angled between 30° and 90° relative to the extraction air heat exchange tunnel, and wherein the supply air heat exchange tunnel and the extraction air heat exchange tunnel are substantially circular in cross-section, with the supply tunnel wall and the extraction tunnel wall each including a plurality of ribs extending from a periphery of the respective wall towards a cross-sectional center of the respective tunnel.

2. The air conditioning system as claimed in of claim 1, wherein a first portion of the extraction tunnel wall that is configured to be connected to the thermo electric cell has a greater thickness than a second portion of the extraction tunnel wall that is not configured to be connected to the thermo electric cell.

3. The air conditioning system of claim 1, wherein:

the first side of the thermo electric cell is mounted on a thermal transfer block; and the supply tunnel wall is attached to the thermal transfer block or the thermal transfer block is integral with the supply tunnel wall.

4. The air condition system of claim 3, wherein a first portion of the extraction tunnel wall is configured to be connected to the thermo electric cell via another thermal transfer block, and wherein the first portion of the extraction tunnel wall has a greater thickness than a second portion of the extraction tunnel wall that is not configured to be connect to the thermo electric cell.

5. The air conditioning system of claim 1, further comprising at least one fan that is configured to generate air flow through the supply air heat exchange tunnel and/or the extraction air heat exchange tunnel.

6. The air conditioning module of claim 1, further comprising:

a supply fan located at an end of the supply air heat exchange tunnel, the supply fan being configured to draw air from a return air duct of the air conditioning module and to move the air from the return air duct through the supply air heat exchange tunnel to facilitate heat transfer; and an extraction fan located at an end of the extraction air heat exchange tunnel, wherein the extraction fan is configured to move air through the extraction air heat exchange tunnel to facilitate heat transfer.

7. The air conditioning system of claim 1, further comprising a return air duct configured to receive air from the room, and enable the air from the room to be supplied to the supply air heat exchange tunnel for conditioning.

8. The air conditioning system of claim 1, wherein each of the ribs tapers in cross section as the ribs extend from a sidewall of the respective wall, wherein adjacent ribs alternate in length between a first length and a second length.

9. The air conditioning system of claim 1, wherein the supply air baffle passes through at least part of a wall insert block mounted to the cavity wall.

10. The air conditioning system of claim 1, wherein a ratio between a length of the supply air heat exchange tunnel and the extraction air heat exchange tunnel is between 8:7 and 4:1.

11. The air conditioning system of claim 1, wherein the air conditioning module further comprises:

a sensor;

a control system in communication with the sensor; and one or more fans configured to move air through the supply air heat exchange tunnel and/or the extraction air heat exchange tunnel;

wherein the control system is configured to control the thermo electric cell and/or the one or more fans based at least in part on sensor data generated by the sensor.

12. The air conditioning system of claim 11, wherein:

the sensor is a temperature sensor configured to generate sensor data that is indicative of a temperature of the thermo electric cell; and the control system is configured to disable the thermo electric cell in response to the sensor data indicating that a temperature of the thermo electric cell meets a temperature criteria.

13. An air conditioning system that is configured to be mounted at a wall, the air conditioning system, comprising:

a cavity wall comprising:

an inner wall;

an outer wall, the inner wall and the outer wall being spaced apart to form a cavity; and an air conditioning module mounted to the cavity wall, the air conditioning module comprising:

a plurality of thermo electric cells, each thermo electric cell having a first side and a second side, and being operable to maintain a temperature difference between the first side and the second side;

a plurality of supply tunnel walls, each defining a respective supply air heat exchange tunnel, wherein each supply air heat exchange tunnel is configured to receive and condition air from a room to produce conditioned air, wherein each supply tunnel wall is configured to be connected to the first side of a respective thermo electric cell of the plurality of thermo electric cells at a first portion of the respective supply tunnel wall, wherein the first portion of each supply tunnel wall has a greater thickness than a second portion of each supply tunnel wall that is not configured to connect to the respective thermo electric cell;

a plurality of supply air ducts, each being configured to receive the conditioned air from a respective one of the supply air heat exchange tunnels, each supply air duct extending through the outer wall and being fluidly isolated from the cavity;

a supply air baffle extending through at least part of the inner wall, the supply air baffle being fluidly isolated from the cavity, and being configured to be fluidly connected to the plurality of supply air ducts, and direct the conditioned air from the plurality of supply air ducts in a direction parallel to the inner wall, thereby enabling an exchange of thermal energy between the conditioned air and the inner wall, along the inner wall; and a plurality of extraction tunnel walls, each defining a respective extraction air heat exchange tunnel that is fluidly connected to the cavity, each extraction tunnel wall being configured to connect to the second side of a respective thermo electric cell of the plurality of thermo electric cells, receive air from the cavity, enable thermal energy to be transferred from the respective thermo electric cell to the received air, and to enable the received air to be vented thereby venting unwanted thermal energy, wherein each supply air heat exchange tunnel is angled at between 30° and 90° relative to the adjacent extraction air heat exchange tunnel(s), and wherein the supply air heat exchange tunnels and the extraction air heat exchange tunnels are substantially circular in cross-section, with the supply tunnel walls and the extraction tunnel walls each including a plurality of ribs extending from a periphery of the respective wall towards a cross-sectional center of the respective tunnel.

14. The air conditioning system of claim 13, wherein the supply air baffle passes through at least part of a wall insert block mounted to the cavity wall.

15. The air conditioning system of claim 13, wherein the supply air baffle passes through at least part of a wall insert block mounted to the cavity wall.

16. The air conditioning system of claim 13, wherein each of the ribs tapers in cross section as the ribs extend from a sidewall of the respective wall, wherein adjacent ribs alternate in length between a first length and a second length.

17. The air conditioning system of claim 13, wherein a first portion of each of the extraction tunnel walls is configured to be connected to the respective thermo electric cell via a thermal transfer block; and the first portion of each of the extraction tunnel walls has a greater thickness than a second portion of the respective extraction tunnel wall that is not configured to be connected to that thermo electric cell.

18. The air conditioning system of claim 13, wherein a ratio between a length of one or more of the supply air heat exchange tunnels and one or more of the extraction air heat exchange tunnels is between 8:7 and 4:1.

19. An air conditioning system comprising:

a cavity wall comprising:

an inner wall; and, an outer wall, the inner wall and the outer wall being spaced apart to form a cavity; and an air conditioning module mounted to the cavity wall, the air conditioning module comprising:

a thermo electric cell having a first side and a second side, the thermo electric cell being operable to maintain a temperature difference between the first side and the second side;

a supply tunnel wall defining a supply air heat exchange tunnel, the supply air heat exchange tunnel being configured to receive and condition air from a room to produce conditioned air, and the supply tunnel wall being configured to be connected to the first side of the thermo electric cell, the first side of the thermo electric cell being configured to be attached to the supply tunnel wall with a thermal transfer block disposed between the supply air heat exchange tunnel and the thermo electric cell, wherein a first portion of the supply tunnel wall that is configured to be connected to the thermo electric cell via the thermal transfer block has a greater thickness than a second portion of the supply tunnel wall that is not configured to be connected to the thermo electric cell;

a supply air duct configured to receive the conditioned air from the supply air heat exchange tunnel, the supply air duct extending through the outer wall and being fluidly isolated from the cavity;

a supply air baffle extending through at least part of the inner wall, the supply air baffle being fluidly isolated from the cavity, and being configured to be fluidly connected to the supply air duct, and direct the conditioned air from the supply air duct in a direction parallel to the inner wall, thereby enabling an exchange of thermal energy between the conditioned air and the inner wall, along the inner wall;

an extraction tunnel wall defining an extraction air heat exchange tunnel that is fluidly connected to the cavity, the extraction tunnel wall being configured to be connected to the second side of the thermo electric cell, wherein the extraction tunnel wall is configured to receive air from the cavity, to enable thermal energy to be transferred from the thermos electric cell to the received air, and to enable the received air to be vented, thereby venting unwanted thermal energy, wherein a first portion of the extraction tunnel wall that is configured to be connected to the thermo electric cell has a greater thickness than a second portion of the extraction tunnel wall that is not configured to be connected to the thermo electric cell; and at least one fan being configured to generate air flow through the supply air heat exchange tunnel and/or the extraction air heat exchange tunnel, wherein the supply air heat exchange tunnel is angled at between 30° and 90° relative to the extraction air heat exchange tunnel.

20. The air conditioning system of claim 19, wherein a ratio between a length of the supply air heat exchange tunnel and the extraction air heat exchange tunnel is between 8:7 and 4:1.

* * * * *